United States Patent [19]

Swamy

[11] Patent Number: 4,587,752

[45] Date of Patent: May 13, 1986

[54] EXHIBITOR MEANS

[76] Inventor: Avvari R. Swamy, Littleton, N.C. 27850

[21] Appl. No.: 712,673

[22] Filed: Mar. 18, 1985

[51] Int. Cl.[4] ..... G09F 1/10

[52] U.S. Cl. ..... 40/124; 40/10 R; 40/124.4; 40/594; 40/11 R

[58] Field of Search ..... 40/124, 10 R, 11 R, 40/124, 124.4, 594; 248/205.3, 174, 309.1, 317, 205.3; 211/113, 86, 119

[56] References Cited

U.S. PATENT DOCUMENTS

| | | | |
|---|---|---|---|
| 2,042,672 | 6/1936 | Maclean | 40/124 |
| 2,278,695 | 4/1942 | Fluss | 40/124 |
| 2,913,843 | 11/1959 | Wittick | 40/124 |
| 2,939,234 | 6/1960 | Hill | 40/11 R |
| 3,035,362 | 5/1962 | Kweskin | 40/124 |
| 3,121,966 | 2/1964 | Upton | 40/10 R |
| 3,327,419 | 6/1967 | Stanos | 40/124 |
| 3,581,419 | 6/1971 | McCracken | 40/124 |
| 3,853,226 | 12/1974 | Hine et al. | 40/124.4 |
| 4,052,805 | 10/1977 | Potter | 40/124 |
| 4,245,414 | 1/1981 | Shypula | 40/124 |
| 4,483,502 | 11/1984 | Fast | 40/10 R |

*Primary Examiner*—Gene Mancene
*Assistant Examiner*—James Hakomaki
*Attorney, Agent, or Firm*—Mills and Coats

[57] ABSTRACT

This invention is an exhibiting means in the form of an upright member with a plurality of arms for posting memoranda, checks, lab reports, and the like. The support arms are secured to the upright in overlapping fashion and include a rib or strong back to hold the posted material attached to the arms outwardly so that each can be easily seen and accessed.

3 Claims, 4 Drawing Figures

EXHIBITOR MEANS

FIELD OF INVENTION

This invention relates to display means and more particularly to exhibitor means for supporting memoranda, lab notes, reports, etc. in staggered, stacked display.

BACKGROUND OF INVENTION

Since man first began to write and make notes, keeping up with the same has been a problem. In busy areas such as hospitals, rest homes, and even business offices and homes, a problem exists of having written material readily available and organized without being spread out and cluttered or placed in unorganized piles.

A few display means have been developed in an effort to overcome the above-mentioned problems. These have invariably either been too complicated and time consuming to be practiced or they have simply failed to accomplish the desired result of ready insertion and removal in an organized manner with ready visual and physical access to the same.

BRIEF DESCRIPTION OF INVENTION

After much research and study into the above mentioned problems, the present invention has been developed to provide an upright, space saving exhibitor means with a plurality of overlapping support arms with stiffening ribs associated therewith for making each note, memoranda, or the like stand out from its adjacent note, memoranda, or the like for ready visual and physical access thereto. An upright member is provided with the support arms outwardly extending from either one side thereof or from opposite sides thereof as desired. Since a large number of items can be overlappingly but separately displayed at any given time, organization of a relatively large amount of material can be accomplished.

In view of the above, it is an object of the present invention to provide an exhibitor means for paper type items which displays the same in overlapping but spaced relationship.

Another object of the present invention is to provide an exhibitor means for flexible type items wherein such items are secured to support arms by means such as an adhesive.

Another object of the present invention is to provide an exhibitor means for flexible items wherein support means associated therewith include angulated arms to allow overlapped as well as spaced exhibition of the items for ready visual and physical access.

Another object of the present invention is to provide a compact and yet highly accessible exhibitor means for flexible, sheet like material.

Another object of the present invention is to provide a relatively inexpensive and yet highly efficient means for organizing memoranda, notes, lab reports, checks, and the like.

Other objects and advantages of the present invention will become apparent and obvious from a study of the following description and the accompanying drawings which are merely illustrative of such invention.

DETAILED DESCRIPTION OF INVENTION

With further reference to the drawings, the exhibitor means of the present invention, indicate generally at 10, can if desired, include a generally rectangular base 11 having feet 12 disposed on the bottom thereof. These feet are preferably formed from rubber, neoprene or similar material with a high friction coefficient to prevent a slippage on finished surfaces and yet will not mar such surfaces.

An upright member 13 formed from a relatively stiff material such as wood, plastic, or the like, is secured to a base 11 by means such as screw 14 so that the same can be shipped in knocked-down condition and then assembled for use.

Figure 1:
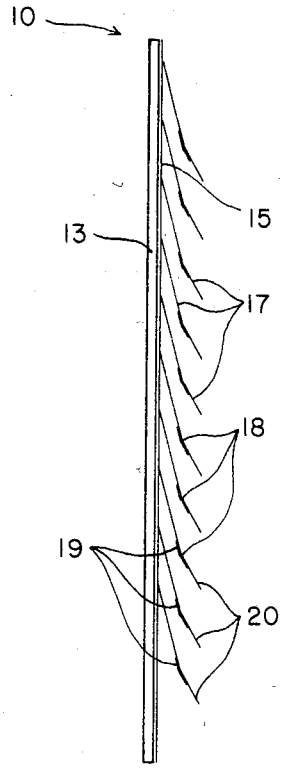
FIG. 1 is an elevational view of the means of the present invention with exhibitor arms on only one side thereof.
Figure 3:
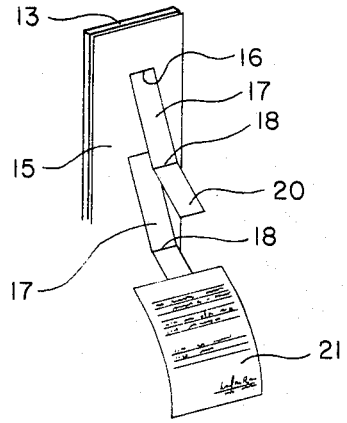
FIG. 3 is a somewhat enlarged front perspective view of a portion of the exhibitor means of the present invention.
Figure 4:
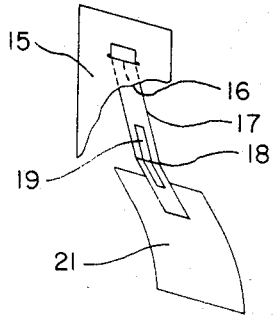
FIG. 4 is a cutaway view illustrating the rear of a typical exhibit arm showing the stiffening means associated therewith.
Figure 2:
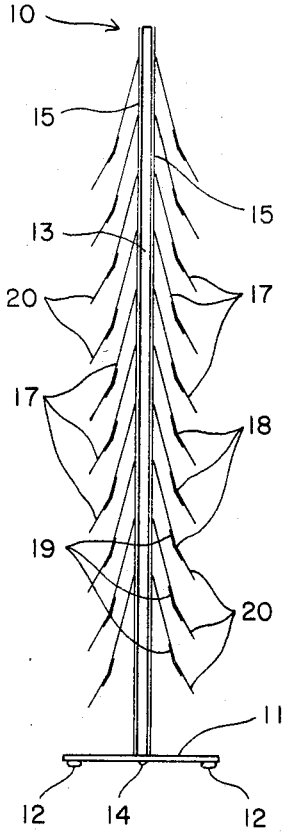
FIG. 2 is an elevational view of the means of the present invention with exhibitor arms on both sides thereof.

Regardless of whether the exhibitor 10 is used with a base as shown in FIG. 2 or without such base as shown in FIG. 1, for each set of exhibitor arms is provided an exhibitor backing 15 formed from a relatively stiff material such as plastic, cardboard, or the like. Slots 16 are provided in backing 15 with exhibitor arms 17 secured therein and extending outwardly therefrom at a downward angle as can clearly be seen in FIGS. 1 and 2.

Each of the exhibitor arms 17 has a bend therein as indicated at 18. On the rear side of the exhibitor arms 17, in the area of the bend 18, is a stiffener 19 formed from plastic, metal, or other suitable material. This stiffener assures that the outward angle that the exhibitor arm takes will be maintained at all times.

On the outer end of the upper surface of each of the exhibit arms 17 is a document securing means such as adhesive coating 20. This adhesive coating can be of the type wherein a protective sheet is placed thereover until the same is ready to use wherein the protective sheet is removed exposing the adhesive which can then be contacted with the document or other item 21 being posted. Since adhesive surfaces of the type described are well known to those skilled in the art, a further detailed discussion of the same is not deemed necessary.

From the above, it can be seen that a plurality of a flap like exhibitor arms 17 are provided which outwardly extend at a downward angle from backing 17. The stiffener 19 at bend 18 causes the exhibitor arm 17 to extend even further outwardly as can clearly be seen in the Figures. The item 20 being posted will tend to droop downwardly but is held secured at such an upwardly angle that such posted item can readily be seen by scanning the means 10 of the present invention and can be readily accessed for removal and replacement as needed.

The means of the present invention requires very little space for a large number of posted items 21 with each of such item being readily visually and physically accessible. The means is also relatively inexpensive to produce and yet is durable for an extended use life.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An exhibitor means comprising: a generally vertical support member; a backing secured to said support member and having a plurality of horizontal slots vertically spaced thereon; a plurality of flat, finger-like exhibitor arms extending substantially downwardly, in an overlapping fashion, from respective horizontal slots on said backing, said exhibitor arms having a bent configuration so that the free end thereof extends substantially outwardly from said support member; stiffener means on said exhibitor arm for maintaining the outwardly bent configuration of the same; and adhesive means for securing memoranda and the like to said free end of said exhibitor arms.

2. The exhibitor means of claim 1 wherein a base is secured to said support member to allow the same to be standing.

3. The exhibitor means of claim 1 wherein the outwardly bent configurations of said exhibitor arms forms an obtuse angle.

* * * * *